US005208406A

United States Patent [19]

Badali

[11] Patent Number: 5,208,406

[45] Date of Patent: May 4, 1993

[54] THUMB SAFETY FOR EXPOSED HAMMER FIREARMS

[75] Inventor: Joseph A. Badali, Ogden, Utah

[73] Assignee: Browning, Ogden, Utah

[21] Appl. No.: 800,447

[22] Filed: Nov. 26, 1991

[51] Int. Cl.[5] ..... F41A 17/74

[52] U.S. Cl. ..... 42/70.08; 89/148

[58] Field of Search ..... 42/70.08, 70.11, 70.01, 42/96, 1.04; 89/146, 148, 154

[56] References Cited

U.S. PATENT DOCUMENTS

| | | | |
|---|---|---|---|
| 273,070 | 2/1883 | Hart | 42/70.08 |
| 982,152 | 1/1911 | Marble | 42/70.08 |
| 2,846,925 | 8/1958 | Norman | 42/70.08 |
| 3,624,947 | 12/1971 | Worrall, Sr. | 42/70.08 |
| 3,838,533 | 10/1974 | Ruger | 42/70.08 |
| 4,316,340 | 2/1982 | Kahn | 42/70.08 |
| 4,461,110 | 7/1984 | Inderbitzen | 42/70.08 |

FOREIGN PATENT DOCUMENTS

| | | | |
|---|---|---|---|
| 3132284 | 2/1983 | Fed. Rep. of Germany | 42/70.08 |
| 398279 | 6/1909 | France | 42/70.01 |
| 11418 | of 1912 | United Kingdom | 42/70.08 |

*Primary Examiner*—Stephen M. Johnson
*Attorney, Agent, or Firm*—Trask, Britt & Rossa

[57] ABSTRACT

A safety system for firearms is provided for a firearm of the type in which a hammer is urged into a cocked position and then actuated by a trigger. The safety system includes a thumb safety which is movably mounted on the hammer. The thumb safety and the hammer comprise a hammer assembly, which has a firing configuration in which it is configured to strike the firing pin. When the hammer assembly is in its safe configuration, the thumb safety precludes the hammer from actuating.

4 Claims, 3 Drawing Sheets

THUMB SAFETY FOR EXPOSED HAMMER FIREARMS

BACKGROUND OF THE INVENTION

1. Field

The present invention relates to a safety system for firearms, and is more particularly directed to a safety associated with a hammer to isolate the hammer from the firing pin of a firearm.

2. State of the Art

Loaded firearms are often used in hunting or other field situations in which the individual carrying the firearm may stumble or fall. Also, loaded firearms are occasionally inadvertently left in places where they may fall or be struck by other objects. Therefore, it is important that firearms have some type of "safety" mechanism to preclude loaded firearms from discharging when struck or jarred.

Typical safety systems include finger-actuated mechanisms conveniently located near the trigger of the firearm so that the shooter may disenable the firing mechanism. Certain firearms feature an exposed hammer which may be manually cocked or decocked. In normal operation, the hammer is released by a trigger pull from its cocked condition to strike a firing pin, thereby to discharge the gun. On such guns, disenabling the trigger mechanism is not entirely effective in precluding an accidental discharge, particularly if the hammer is directly contacted by a hard surface such as a rock or hard ground. Exposed hammer firearms can be discharged under certain conditions even when the hammer is in decocked condition.

Certain exposed-hammer firearms are structured so that the hammer may be placed in a "half-cock" position. Structure associated with the hammer allows it to be pulled back slightly and then to be eased into a "safe" position intermediate its "cocked" position and its "battery" or fired position. The spring or other biasing means associated with the hammer is of a strength selected so that it cannot deliver momentum to the hammer released from this "half-cocked" position sufficient to impact the firing pin with enough force to discharge a loaded shell. Nevertheless, if the hammer receives a sufficient blow, such as if the hammer is dropped directly on a rock, it is possible for the hammer to be released from its half-cocked position with sufficient momentum to discharge a shell.

There remains a need for a safety system for use in firearms having exposed hammers which will positively preclude the hammer from impacting the firing pin even when the hammer is directly contacted.

SUMMARY OF THE INVENTION

The present invention provides a safety system for firearms in which a hammer assembly is urged into a cocked position and then actuated by a trigger. A thumb safety is mounted on the hammer to form a hammer assembly with the hammer. The thumb safety moves between a first, "firing," position in which the hammer assembly is configured to strike the firing pin, and a second, "safe," position in which the assembly is configured such that it cannot strike the firing pin. When the hammer assembly is in its firing configuration, a striking surface is formed on the hammer assembly in registration with the firing pin. Preferably, the striking surface is formed on the thumb safety member of the assembly.

In a typical embodiment, the safety system is associated with a firearm in which the hammer is adapted for placement in a half-cocked position. The hammer assembly may be configured to ensure that it assumes its safe configuration any time the hammer is released from a position intermittent its full cock and its half-cocked positions. The hammer assembly is ideally configured to interact physically with other structure, such as a bolt assembly, of the firearm to positively isolate the striking surface of the hammer assembly from the firing pin.

Preferably, the safety system includes registration means associated with the thumb safety to provide a semi-rigid registration of the thumb safety in its safe position. A ball and detent arrangement is a satisfactory such registration system.

In a highly preferred embodiment, the hammer is rotatably mounted to the firearm and the thumb safety is rotatably mounted to the hammer.

DETAILED DESCRIPTION OF THE PREFERRED EMBODIMENT

Figure 1:
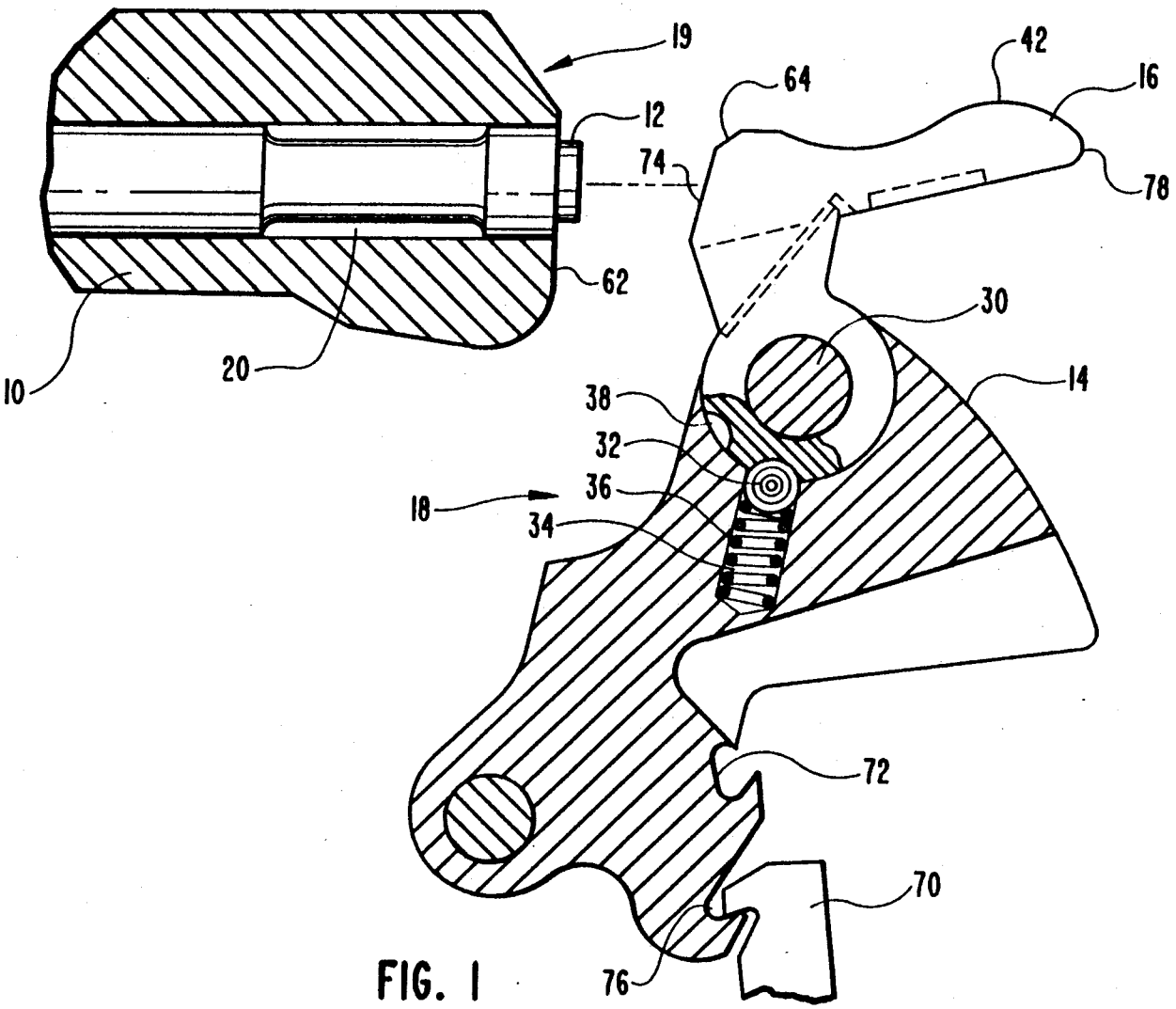
FIG. 1 is a side view in elevation, partially in section, of a hammer and thumb safety assembly of this invention in association with a bolt assembly, the hammer and thumb safety being shown in half cock position.

Referring to the figures of the drawing, a safety system of the present invention includes a breech bolt slide 10, a firing pin 12, a hammer 14, and a thumb safety 16. Hammer 14 and thumb safety 16 act together as a hammer assembly, designated generally 18. The slide 10 and firing pin 12 are components of a bolt assembly, designated generally 19. Only a fragment of the bolt assembly 19 is shown to assist in visualizing the positioning of components of the hammer assembly 18 with respect to the firing pin 12 and the rear surfaces of the bolt slide 10.

The bolt assembly 1 9 functions to hold a loaded shell in its battery position. This assembly 19 may also serve as an integral part of the loading and unloading mechanism of the firearm in conventional fashion. The firing pin 12 slidingly associates within cylindrical channel 20 of the slide 10. Hammer 14 is rotatably associated with other structure of the firearm in conventional arrangement (not shown). Hammer 14 is associated with structure which allows it to be placed in either a half cocked position, as shown in FIG. 1, or a cocked position, in which hammer 14 is rotated, e.g. about 20° to about 50° from its position as shown in FIG. 1. Hammer 14 also associates with a trigger mechanism of the firearm (not shown) which is adapted so that when the hammer is placed in its cocked position, the trigger mechanism may be actuated to release the hammer. The hammer assembly 18 is then rotated counterclockwise at a high rate of speed under the influence of a spring or other biasing member in conventional fashion to discharge a chambered shell.

Thumb safety 16 is rotatably connected to hammer 14 by means of a saddle bolt 30. Spherical ball 32 is slidingly housed within cylindrical channel 34 formed in hammer 14. Coil spring 36, also contained within cylindrical channel 34, biases ball 32 toward thumb safety 16. When thumb safety 16 is in its safe position (FIG. 2), spherical ball 32 registers with partially spherical detent 38 formed in thumb safety 16, as shown. Thumb safety 16 is placed in its firing position by being rotated 90° clockwise with respect to hammer 14 from its position shown in FIG. 2. In this position (FIG. 3.), ball 32 registers with partially spherical detent 40 formed in thumb safety 16.

When ball 32 registers with either detent 38 or 40, such registration provides a semi-rigid fixed position for thumb safety 16 with respect to hammer 14. A preselected amount of force is then needed to disengage thumb safety 16 from these semi-rigid registrations. The amount of such force will typically be determined by the size of ball 32, the size of detents 38 or 40, and the strength of spring 36. It is not necessary that the two semi-rigid registration positions require the same amount of force to rotate thumb safety 16. For example, it may be advantageous to make detent 38 larger than detent 40 to make it more difficult to move the thumb safety from its safe position than from its firing position.

Figure 2:
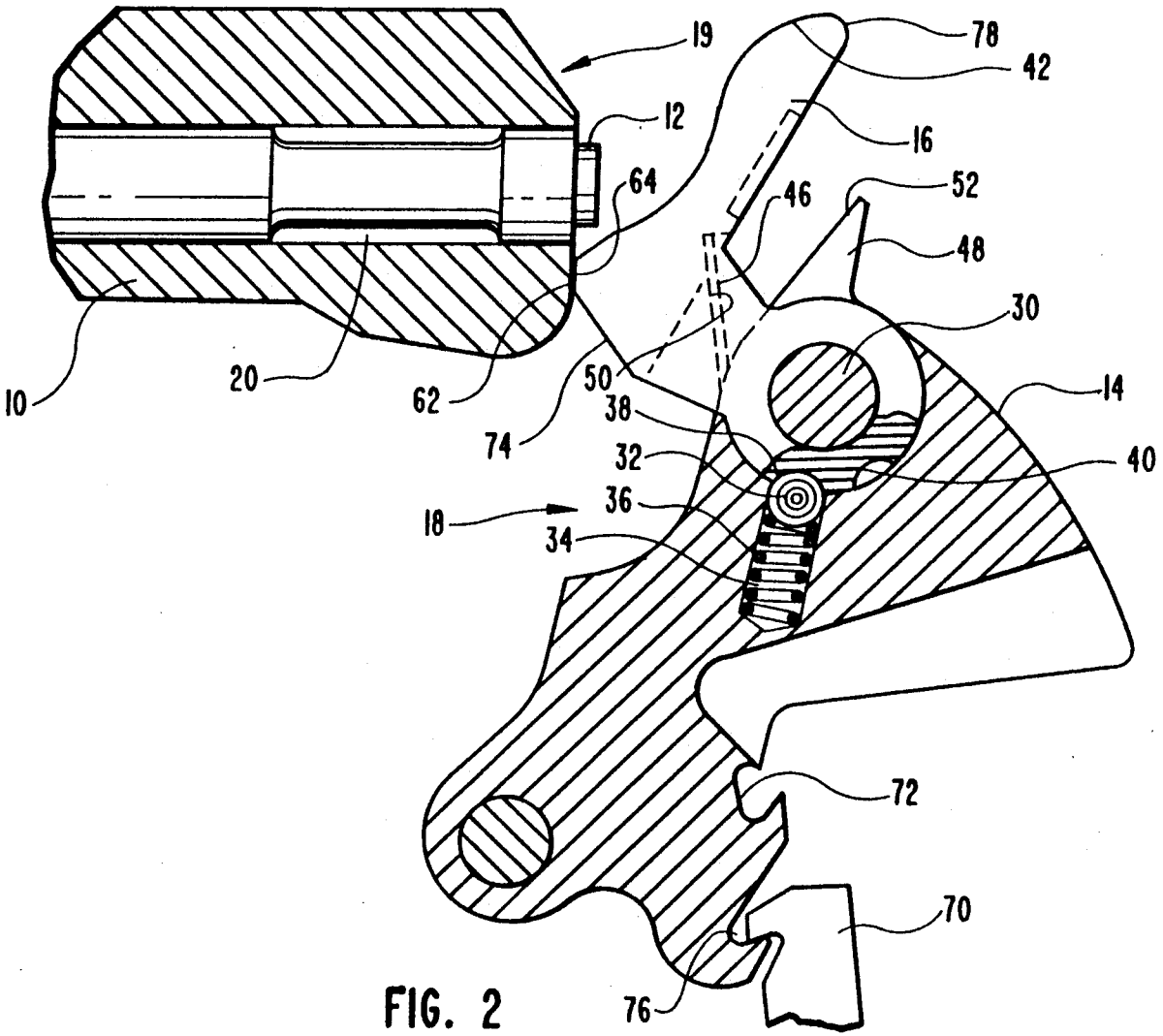
FIG. 2 is a view similar to FIG. 1 showing the hammer in half cock position and the thumb safety in safe position.
Figure 3:
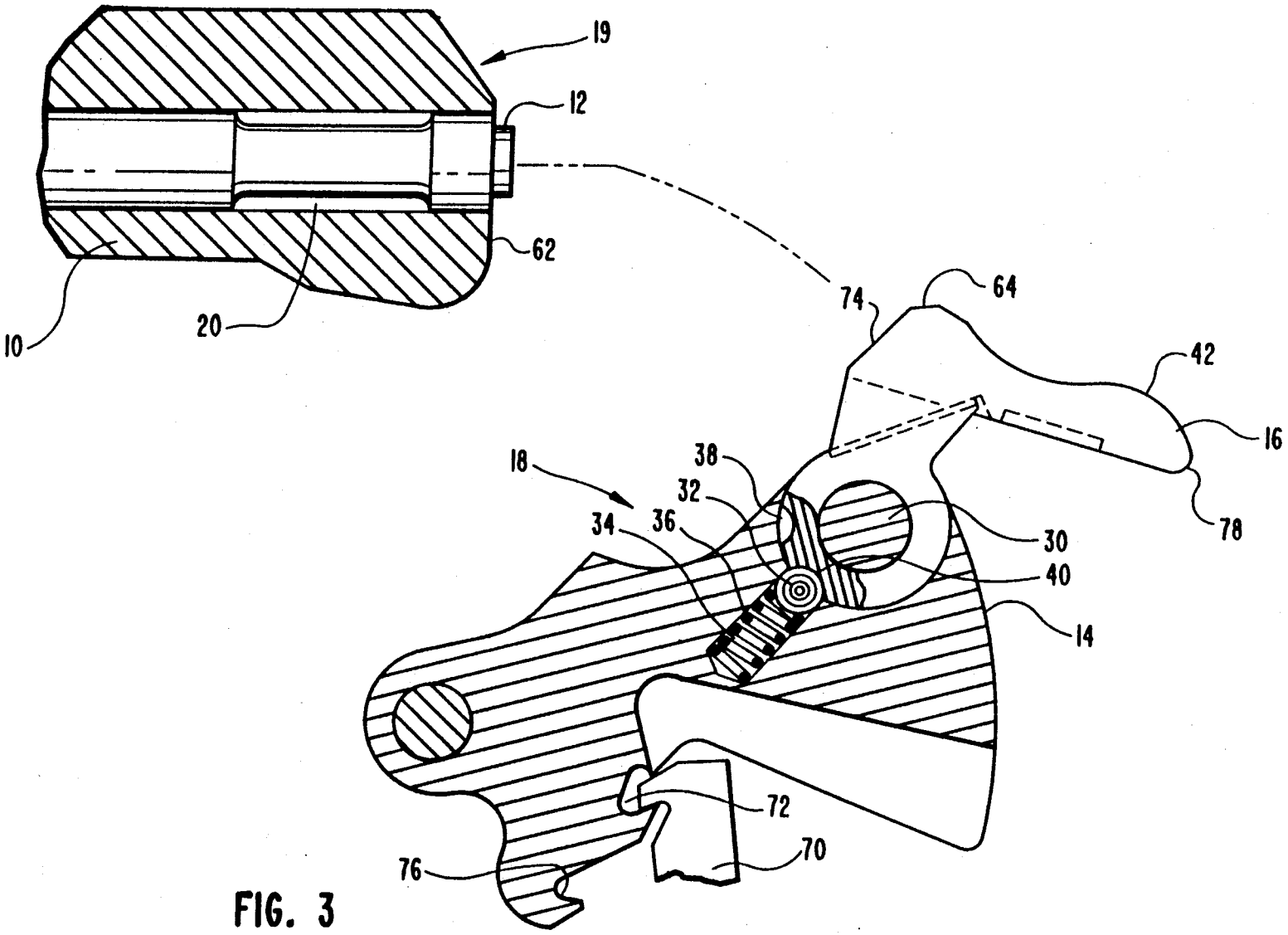
FIG. 3 is a similar view showing the hammer in full cock position and the thumb safety in firing position.

Hammer 14 may be placed in its cocked position by means of thumb pressure applied to surface 42 of thumb safety 16. Detent 38 is thereby caused to move out of registration with ball 32, and thumb safety 16 inherently rotates clockwise (as viewed in the figures) towards its firing position. As thumb safety 16 moves to its firing position, L-shaped channel 46 (best seen in FIG. 2) formed in thumb safety 16 envelopes the tip 48 of hammer 14 until eventually surface 50 formed in channel 46 makes contact with surface 52 of hammer 14. Thumb safely 16 is then in its firing position. As the thumb safety 16 continues to rotate, it forces hammer 14 to also rotate until eventually hammer 14 achieves its cocked position (FIG. 3).

Alternative methods of cocking the firearm are within contemplation. For example, cocking structure may be associated with bolt assembly 19 to cause bolt slide 10 to be driven rearward. As bolt slide 10 is driven rearward, it makes contact with thumb safety 16, whether it is in its safe position or in its firing position. If thumb safety 16 is in its safe position, bolt slide 10 will approximate the action of a manual thumb cocking of the firearm. As bolt slide 10 is driven rearward, for example by a lever action, surface 62 of bolt 10 contacts surface 64 of thumb safety 16. As force is exerted upon surface 64, thumb safety 16 rotates upon hammer 14 until surface 50 of thumb safety 16 contacts surface 52 of hammer 14. Continued rearward motion of bolt slide 18 rotates hammer 14 to its cocked position.

Alternatively, cocking structure may be directly mechanically linked to hammer 14 to cause it to rotate to its cocked position upon actuation of a cocking mechanism. Thumb safety 16 may also be mechanically linked to the cocking mechanism by structure which causes it to rotate to its firing position upon actuation of the cocking mechanism.

With the hammer 14 in its cocked position, the trigger mechanism is enabled, presuming that other safety systems have been disengaged. The thumb safety 16 may then be placed in its firing position. The hammer assembly 18 is then configured to discharge the firearm. As the trigger mechanism is actuated, typically by a trigger pull, a cocking sear 70 is pulled from the full cock notch 72 (FIG. 3), and hammer 14 is released from its cocked position to rotate at a high rate of speed, along with thumb safety 16, counterclockwise (as viewed in the figures) toward firing pin 12. Hammer 14 and thumb safety 16 rotate as a unit until surface 74 of thumb safety 16 strikes the pin 12.

Starting with the thumb safety 16 in its firing position and hammer 14 in its cocked position, as shown by FIG. 3, thumb pressure on surface 42 of thumb safety 16 may urge hammer 14 to rotate slightly clockwise upon its associated structure. As hammer 14 is rotated slightly clockwise from its cocked position, sear 70 releases the full cock notch 72. The hammer 14 may then be eased counterclockwise until the sear 70 engages the half cock notch 76. The hammer assembly is then held in its half cocked position, as shown by FIGS. 1 and 2.

Once hammer 14 has achieved its half-cocked position, a slight amount of force near the tip 78 of thumb safety 16 causes it to disengage, at detent 40, from ball 32. Continued rotation of thumb safety 16 counterclockwise engages it in its safe position as shown in FIG. 2.

With the thumb safety in its safe position, should the firearm receive a jar, or a direct blow to hammer 14 or thumb safety 16 (causing hammer 14 to disengage from its half-cocked position), surface 64 of thumb safety 16 contacts surface 62 of bolt slide 10, thereby preventing hammer 14 from rotating counterclockwise. Additionally, surface 74 of thumb safety 16 (which is the striking surface for the firing pin 12) is moved out of registration with firing pin 12.

Reference herein to details of the illustrated embodiment is not intended to limit the scope of the appended claims which are intended to define the invention including equivalents. Alternative structures are within contemplation for causing thumb safety 16 to register into its safe or firing positions other than the ball and detent arrangement illustrated. This registration mechanism functions to cause thumb safety 16 to register firmly enough into its safety position to prevent hammer 14 from rotating if released from its half-cocked position.

What is claimed:

1. A safety system for firearms of the type in which a hammer may be urged into a cocked position and may then be actuated by operation of a trigger to cause striking of a firing pin, said safety system comprising:

a hammer pivotally mounted to cause striking of a firing pin, said hammer including a tip projecting therefrom;

a thumb safety carried by and rotatably mounted with respect to said hammer, said thumb safety including a portion projecting from the hammer and having a surface thereon for engaging said tip projecting from said hammer, a surface for striking the firing pin, and a thumb pressure application surface, said thumb pressure application surface and said surface for engaging said tip of said hammer being aligned with said tip for engagement of said tip by said thumb safety upon rotation of the thumb safety to move said hammer into a selected half-cocked position and a firing position, and upon rotation of the thumb safety away from engagement with said tip to a safe position with the surface on the thumb safety for striking the firing pin out of alignment to engage said firing pin and said thumb safety in position to engage other structure and block engagement of the thumb safety with the firing pin; and means to semi-fix the position of the thumb safety with respect to the hammer in the firing position and in the safe position, said means comprising semi-spherical detents formed in the thumb safety and a spring-biased ball carried by the hammer and selectively biased into said detents.

2. A safety system for firearms according to claim 1, wherein said thumb safety includes an "L"-shaped channel formed thereon and having the surface for engaging the tip therein, said channel enveloping the tip of the hammer during rotation of the thumb safety to the firing position.

3. A safety system for firearms according to claim 2, wherein the hammer further includes means to be engaged by a trigger cocking sear to releasably hold said hammer in said half-cocked position and said cocked position.

4. A safety system for firearms according to claim 3, wherein the firing pin reciprocates within a bolt comprising said other structure and the surface on the thumb safety for striking the firing pin is positioned to engage the bolt when the thumb safety is in the safe position.

* * * * *